United States Patent [19]

Seino et al.

[11] Patent Number: 4,639,694

[45] Date of Patent: Jan. 27, 1987

[54] POWER DISTRIBUTION CIRCUIT HAVING CENTER PORTIONS OF ISOLATION RESISTORS CONNECTED TOGETHER

[75] Inventors: Kiyoharu Seino; Tadashi Takagi; Fumio Takeda, all of Kamakura, Japan

[73] Assignee: Mitsubishi Denki Kabushiki Kaisha, Japan

[21] Appl. No.: 726,322

[22] Filed: Apr. 23, 1985

[30] Foreign Application Priority Data

Apr. 27, 1984 [JP] Japan ..... 59-85833

[51] Int. Cl.[4] ..... H01P 5/12

[52] U.S. Cl. ..... 333/128; 333/136

[58] Field of Search ..... 333/128, 127, 125, 117, 333/100, 136; 330/286

[56] References Cited

U.S. PATENT DOCUMENTS 2,877,427 3/1959 Butler ..... 333/128

3,904,990 9/1975 La Rosa ..... 333/128

FOREIGN PATENT DOCUMENTS 1360391 3/1963 France ..... 333/100

OTHER PUBLICATIONS

Wilkinson, Ernest; "An N-Way Hybrid Power Divider", *IRE Transactions on Microwave Theory and Techniques;* Jan. 1960, MTT 8; pp. 116–118.

Taub, J. J. et al; "A Note on N-Way Hybrid Power Dividers"; *IEEE Transaction on Microwave Theory & Techniques;* MTT 12, Mar. 1964, pp. 260–261.

Yee, H. et al; "N-Way TEM Mode Broad Band Power Dividers", *IEEE Transactions on Microwave Theory & Techniques;* MTT 18, No. 10, Oct. 1970; pp. 682–688.

*Primary Examiner*—Eugene R. LaRoche

*Assistant Examiner*—Benny T. Lee

*Attorney, Agent, or Firm*—Leydig, Voit & Mayer

[57] ABSTRACT

A power distribution circuit having two Wilkinson type bi-distribution circuits each of which halves and then distributes its input and formed of a microstrip on a dielectric substrate or a semiconductor substrate. The input terminals of the two Wilkinson type bi-distribution circuits are connected, while substantially middle parts of resistances used as isolation resistances of the respective Wilkinson type bi-distribution circuits are connected by a metallic thin wire.

3 Claims, 4 Drawing Figures

POWER DISTRIBUTION CIRCUIT HAVING CENTER PORTIONS OF ISOLATION RESISTORS CONNECTED TOGETHER

BACKGROUND OF THE INVENTION

This invention relates to a power distribution circuit for quartering and distributing a single input.

FIG. 1 is a front view of a prior-art power distribution circuit. In the figure, numeral 1 designates a dielectric substrate, numerals 2–7 designate distributed constant lines, numerals 8–10 designate resistances, numerals 11 and 12 designate connecting lines, numerals 13–15 desginate Wilkinson type bi-distribution circuits, numeral 16 designate an input terminal, and numerals 17–20 designate output terminals.

The Wilkinson type bi-distribution circuit 13 is composed of the distributed constant lines 2 and 3 and the resistance 8, the Wilkinson type bi-distribution circuit 14 is composed of the distributed constant lines 4 and 5 and the resistance 9, and the Wilkinson type bi-distribution circuit 15 is composed of the distributed constant lines 6 and 7 and the resistance 10.

The Wilkinson type bi-distribution circuits 13 and 14 are connected by the connecting line 11, while those circuits 13 and 15 are connected by the connecting line 12.

The distributed constant lines 2–7 and the connecting lines 11, 12 are formed of a microstrip on the dielectric substrate 1, and the resistances 8–10 are also formed on the dielectric substrate 1 by vapor deposition.

Letting $Z_O$ denote the characteristic impedance of a power supply, the characteristic impedance of each of the distributed constant lines 2–7 is selected at $\sqrt{2}\,Z_O$, and the value of each of the resistances 8–10 is selected at $2\,Z_O$. The electrical distance of each of the distributed constant lines 2–7 is selected at a quarter wavelength.

By selecting the characteristic impedance and electrical distance of each of the distributed constant lines 2–7 and the magnitude of each of the resistances 8–10 at such values, a microwave signal having entered the input terminal 16 is quartered and then distributed to the respective output terminals 17–20. Moreover, isolation is held between the respectively adjacent ones of the output terminals 17–20. This is effective for the power distribution circuit because, due to connections between amplifiers and the respective output terminals 17–20 of the power distribution circuit by way of example, when only the amplifier connected to the output terminal 17 has broken down due to any cause, the breakdown does not affect the amplifiers connected to the other output terminals 18–20.

The power distribution circuit of this type, however, has had the disadvantage that three Wilkinson type bi-distribution circuits are required, resulting in large geometries.

SUMMARY OF THE INVENTION

In order to eliminate the disadvantage, this invention provides an arrangement which employs two Wilkinson type bi-distribution circuits and in which input terminals of the respective Wilkinson type bi-distribution circuits are connected, while longitudinal center parts of resistances of the respective Wilkinson type bi-distribution circuits are connected by a metallic thin wire.

DESCRIPTION OF THE PREFERRED EMBODIMENTS

Figure 2A:
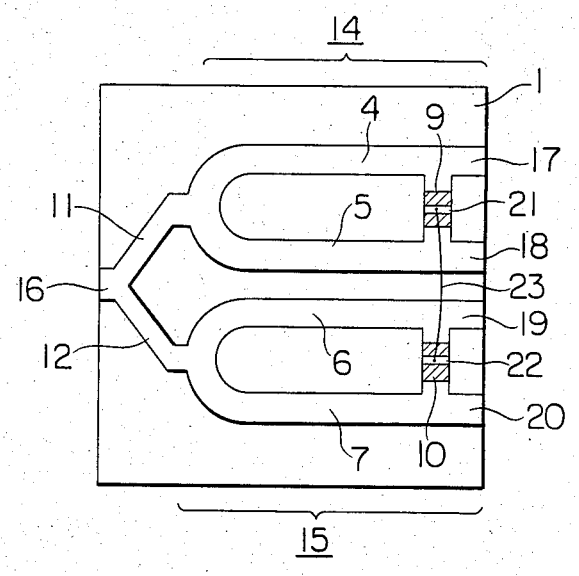
FIG. 2(*a*) is a front view showing an embodiment of a power distribution circuit according to this invention, while FIG. 2(*b*) is an equivalent circuit diagram of the embodiment shown in FIG. 2(*a*)
Figure 2B:
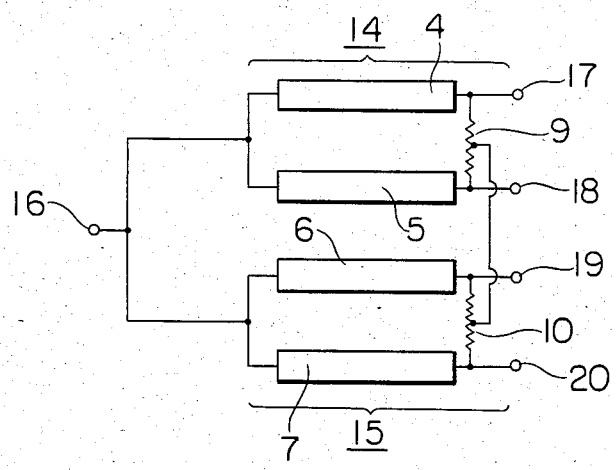

FIG. 2(*a*) is a front view showing one embodiment of this invention. In this figure, numerals 21 and 22 indicate metal islands, and numeral 23 indicates a metallic thin wire.

The input terminals of Wilkinson type bi-distribution circuits 14 and 15 are respectively connected to an input terminal 16 through connecting lines 11 and 12. In addition, the metal islands 21 and 22 are respectively disposed in the longitudinal center parts of resistances 9 and 10, and they are connected by the metallic thin wire 23.

In a case where the length of each of the connecting lines 11, 12 and the metallic thin wire 23 is selected to be sufficiently shorter than a wavelength concerned, the equivalent circuit of the embodiment in FIG. 2(*a*) is as illustrated in FIG. 2(*b*).

This equivalent circuit becomes equal to the equivalent circuit of a Wilkinson type quadri-distribution circuit.

Therefore, a microwave signal having entered the input terminal 16 is quartered and then distributed to respective output terminals 17–20, and isolation is held between the respectively adjacent ones of the output terminals 17–20.

Figure 1:
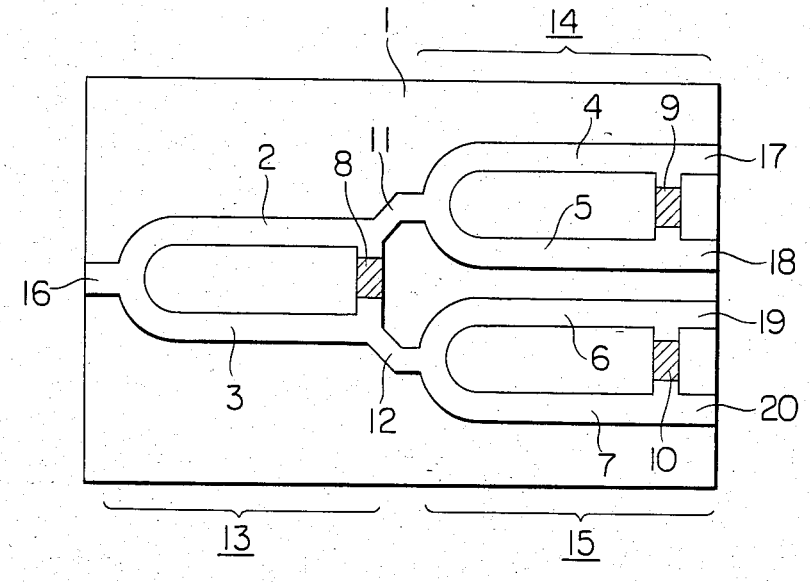
FIG. 1 PRIOR ART
FIG. 1 is a front view of a prior-art power distribution circuit.

In particular, when the characteristic impedance of each of distributed constant lines 4–7 is selected at $2\,Z_O$, the impedance of the right side viewed from the input terminal 16 and also the impedance of the left side viewed from the respective output terminals 17–20 become $Z_O$ which is equal to the impedance of the prior-art power distribution circuit shown in FIG. 1.

Accordingly, while keeping the functions of the prior-art circuit, the power distribution circuit of this invention brings forth the advantage of miniaturization because it can be constructed from only two Wilkinson type bi-distribution circuits.

Figure 3:
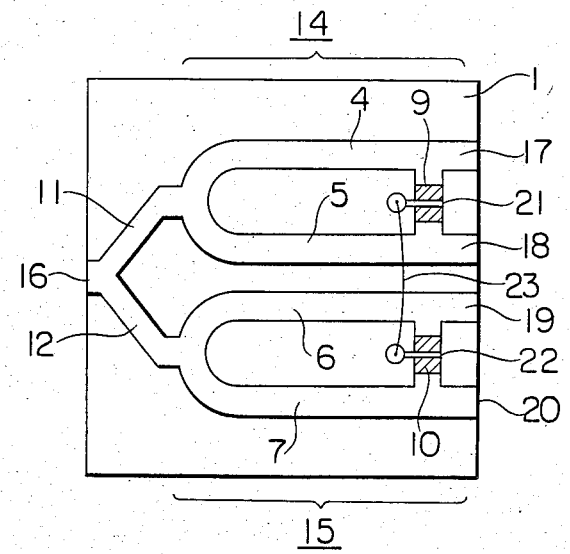
FIG. 3 is a front view of another embodiment of the power distribution circuit of this invention.

FIG. 3 is a front view of another embodiment utilizing the power distribution circuit of this invention.

Even when, as in this power distribution circuit, parts of metal islands 21 and 22 protrude from respective resistances 9 and 10 onto a dielectric substrate 1, the power distribution circuit of this invention still maintains its operation. The longitudinal center parts of the resistances 9 and 10 may well be connected by a metallic thin wire 23 directly without using the metal islands 21 and 22.

Although, in the above, the case of employing the dielectric substrate as a substrate for constructing the power distribution circuit thereon has been explained, the power distribution circuit may well be constructed on a semiconductor substrate such as GaAs substrate. Besides, the power distribution circuit of this invention can be used as a power synthesis circuit.

As set forth above, the power distribution circuit of this invention employs two Wilkinson type bi-distribution circuits, the input terminals of which are connected to the input terminal to the power distribution circuit. Each bi-distribution circuit includes a divider circuit and has an isolation resistor, the longitudinal center resistors being parts of the connected by a metallic thin wire for shunting the output terminals, whereby a power distribution circuit of quartering the power distribution can be constructed.

Whereas a prior-art power synthesis circuit has required three Wilkinson type bi-distribution circuits, the power distribution circuit of this invention can be constructed of the two Wilkinson type bi-distribution circuits and therefore brings forth the advantage that the power distribution circuit can be reduced in size.

What is claimed is:

1. A power distribution circuit for splitting a signal at an input terminal into four output signals at four output terminals comprising:

a substrate, a first and second Wilkinson-type parallel bi-distribution circuit formed of a microstrip on said substrate, said first bi-distribution circuit including a first pair of planar conducting elements on said substrate extending between an input end and a first pair of said output teminals, means connecting the input end of said elements of said first bi-distribution circuit together and to said input terminal of said power distribution circuit, a first isolation resistor formed on said substrate shunting longitudinally between said first pair of output terminals, said second bi-distribution circuit including a second pair of planar conducting elements on said substrate extending between an input end and a second pair of said output terminals, means connecting the input end of said elements of said second bi-distribution circuit together and to said input terminal of said power distribution circuit, a second isolation resistor formed on said substrate shunting longitudinally between said second pair of output terminals, and said power distribution circuit including a metallic thin wire spaced from said substrate and connecting the longitudinal center portions of said first and second isolation resistors together.

2. A power distribution circuit according to claim 1 for splitting a signal of a predetermined wavelength wherein the metallic thin wires are each of a length less than said wavelength.

3. A power distribution circuit according to claim 1 further including metal island holding means for said metallic thin wire substantially in the longitudinal center portion of each said isolation resistor.

* * * * *